US008827556B2

(12) United States Patent
Dais et al.

(10) Patent No.: US 8,827,556 B2
(45) **Date of Patent: *Sep. 9, 2014**

(54) POUCH AND AIRTIGHT RESEALABLE CLOSURE MECHANISM THEREFOR

(75) Inventors: Brian C. Dais, Saginaw, MI (US); Bryan L. Ackerman, Freeland, MI (US); James C. Pawloski, Racine, MI (US); Robert R. Turvey, Sanford, MI (US); Daniel Zimmerman, Livonia, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 241 days.

This patent is subject to a terminal disclaimer.

(21) Appl. No.: 12/970,265

(22) Filed: Dec. 16, 2010

(65) Prior Publication Data

US 2011/0085747 A1 Apr. 14, 2011

Related U.S. Application Data

(62) Division of application No. 11/725,120, filed on Mar. 16, 2007, now Pat. No. 7,886,412.

(51) Int. Cl.

| | |
|---|---|
| ***B65D 33/16*** | (2006.01) |
| ***B65D 81/20*** | (2006.01) |
| ***B65D 33/25*** | (2006.01) |

(52) U.S. Cl.

CPC ..... *B65D 81/2023* (2013.01); *Y10S 24/39* (2013.01); *B65D 81/2038* (2013.01); *B65D 33/2541* (2013.01)

USPC ..... 383/63; 24/DIG. 39

(58) Field of Classification Search

CPC ..... B65D 33/2541; B65D 33/2508; B65D 33/2591; B65D 33/2525; B29L 2005/00

USPC ..... 383/61.2; 24/585.12, 399, DIG. 39

See application file for complete search history.

(56) References Cited

U.S. PATENT DOCUMENTS

| | | | | |
|---|---|---|---|---|
| 2,576,322 | A | 11/1951 | Waters | |
| 2,609,314 | A | 9/1952 | Engel et al. | |
| 2,633,442 | A | 3/1953 | Caldwell | |
| 2,642,372 | A | 6/1953 | Chittick | |
| 2,670,501 | A | 3/1954 | Michiels | |
| 2,759,866 | A | 8/1956 | Seymour | |
| 2,772,712 | A | 12/1956 | Post | |
| 2,776,452 | A | 1/1957 | Chavannes | |
| 2,778,171 | A | 1/1957 | Taunton | |
| 2,778,173 | A | 1/1957 | Taunton | |
| 2,794,228 | A * | 6/1957 | Tcher | 24/590.1 |

(Continued)

FOREIGN PATENT DOCUMENTS

| | | |
|---|---|---|
| JP | 3294043 | 5/2002 |

*Primary Examiner* — Gary Elkins
*Assistant Examiner* — Christopher Demeree

(57) ABSTRACT

A pouch has an elongate closure mechanism adapted to provide vacuum retention within an interior of the pouch over an extended period of time when sealed. The closure mechanism includes a first pair of interlocking members that resealably mate together, a second pair of interlocking members that resealably mate together, and a pair of sealing members that form an air tight seal separate from the interlocking members disposed between the first and second pairs of interlocking members. The closure members are connected with opposing panels of the pouch in a manner designed to provide differential opening and closing forces. The pouch may include a check valve and air evacuation channels to aid in evacuating air from the interior.

12 Claims, 1 Drawing Sheet

(56) References Cited

U.S. PATENT DOCUMENTS 2,821,338 A 1/1958 Metzger
2,823,720 A * 2/1958 Svec et al. ..... 383/65
2,856,323 A 10/1958 Gordon
2,858,247 A 10/1958 De Swart
2,870,954 A 1/1959 Kulesza
2,913,030 A 11/1959 Fisher
2,916,411 A 12/1959 Villoresi
2,927,722 A 3/1960 Metzger
2,960,144 A 11/1960 Graf
3,026,231 A 3/1962 Chavannes
3,060,985 A 10/1962 Vance et al.
3,098,563 A 7/1963 Skees
3,102,676 A 9/1963 Danelli et al.
3,113,715 A 12/1963 Pangrac
3,141,221 A 7/1964 Faults, Jr.
3,142,599 A 7/1964 Chavannes
3,149,772 A 9/1964 Olsson
3,160,323 A 12/1964 Weisberg
3,216,172 A 11/1965 Piazze
3,219,084 A 11/1965 Ausnit et al.
3,224,574 A 12/1965 McConnell
3,237,844 A 3/1966 Hughes
3,251,463 A 5/1966 Bodet
3,302,859 A 2/1967 Perry
3,325,084 A 6/1967 Ausnit
3,372,442 A 3/1968 Ishimatsu
3,381,887 A 5/1968 Lowry
3,389,733 A 6/1968 Siegel
3,411,698 A 11/1968 Reynolds
3,440,696 A 4/1969 Staller
3,464,094 A 9/1969 Mates
3,516,217 A 6/1970 Gildersleeve
3,557,413 A 1/1971 Engle
3,565,147 A 2/1971 Ausnit
3,575,781 A 4/1971 Pezely
3,595,467 A 7/1971 Goglio
3,595,722 A 7/1971 Dawbarn
3,608,439 A 9/1971 Ausnit
3,628,720 A 12/1971 Schmedding
3,633,642 A 1/1972 Siegel
3,655,501 A 4/1972 Tesch
3,679,511 A 7/1972 Ausnit
3,746,215 A 7/1973 Ausnit et al.
3,780,781 A 12/1973 Uramoto
3,790,992 A 2/1974 Herz
3,799,427 A 3/1974 Goglio
3,809,217 A 5/1974 Harrison
3,833,166 A 9/1974 Murray
3,918,131 A 11/1975 Ausnit
3,937,396 A 2/1976 Schneider
3,980,226 A 9/1976 Franz
3,989,182 A 11/1976 Stearley
4,000,846 A 1/1977 Gilbert
4,020,884 A 5/1977 Jadot
4,085,886 A 4/1978 Nishioka
4,101,355 A 7/1978 Ausnit
4,105,491 A 8/1978 Haase et al.
4,122,993 A 10/1978 Glas
4,134,535 A 1/1979 Barthels et al.
4,155,453 A 5/1979 Ono
4,186,786 A 2/1980 Kirkpatrick
4,206,870 A 6/1980 DeVries
4,212,337 A 7/1980 Kamp
4,215,725 A 8/1980 Callet et al.
4,246,288 A 1/1981 Sanborn, Jr.
4,310,118 A 1/1982 Kisida et al.
4,332,344 A 6/1982 Strodthoff
4,340,558 A 7/1982 Hendrickson
4,354,541 A 10/1982 Tilman
4,355,494 A 10/1982 Tilman
4,363,345 A 12/1982 Scheibner
4,372,921 A 2/1983 Sanderson et al.
4,426,816 A 1/1984 Dean et al.
4,430,070 A 2/1984 Ausnit
4,449,243 A 5/1984 Platel
4,470,153 A 9/1984 Kenan
4,491,959 A 1/1985 Loefberg
4,509,642 A 4/1985 Rowell
4,524,460 A 6/1985 Twiehoff et al.
4,528,224 A 7/1985 Ausnit
4,532,652 A 7/1985 Herrington
4,541,117 A 9/1985 Ashbeck
4,550,546 A 11/1985 Raley et al.
4,551,379 A 11/1985 Kerr
4,566,131 A 1/1986 Achelpohl
4,576,283 A 3/1986 Fafournoux
4,578,813 A 3/1986 Ausnit
4,581,764 A 4/1986 Plock et al.
4,653,661 A 3/1987 Buchner et al.
4,660,355 A 4/1987 Kristen
4,672,684 A 6/1987 Barnes et al.
4,691,372 A 9/1987 Van Erden
4,691,373 A 9/1987 Ausnit
4,701,358 A 10/1987 Behr et al.
4,702,376 A 10/1987 Pagliaro
4,712,574 A 12/1987 Perrott
4,715,494 A 12/1987 Heitzenröder et al.
4,730,635 A 3/1988 Linden
4,731,911 A 3/1988 Gould
4,736,450 A 4/1988 Van Erden et al.
4,736,451 A 4/1988 Ausnit
4,747,702 A 5/1988 Scheibner
4,752,992 A 6/1988 Kondo et al.
4,756,628 A 7/1988 Branson
4,756,629 A 7/1988 Tilman et al.
4,778,282 A 10/1988 Borchardt et al.
4,780,937 A 11/1988 Kusayama
4,787,754 A 11/1988 Herrington
4,787,755 A 11/1988 Branson
4,787,880 A 11/1988 Ausnit
4,791,710 A 12/1988 Nocek et al.
4,792,240 A 12/1988 Ausnit
4,795,269 A 1/1989 Scheibner
4,796,300 A 1/1989 Branson
4,807,300 A 2/1989 Ausnit et al.
4,812,056 A 3/1989 Zieke
4,812,074 A 3/1989 Ausnit et al.
4,817,188 A * 3/1989 Van Erden ..... 383/63
4,825,514 A 5/1989 Akeno
4,829,641 A 5/1989 Williams
4,832,505 A 5/1989 Ausnit et al.
4,834,554 A 5/1989 Stetler, Jr. et al.
4,840,611 A 6/1989 Van Erden et al.
4,841,603 A 6/1989 Ragni
4,858,286 A 8/1989 Siegel
4,859,259 A 8/1989 Scheibner
4,863,286 A 9/1989 Branson
4,869,725 A 9/1989 Schneider et al.
4,875,259 A 10/1989 Appeldorn
4,877,334 A 10/1989 Cope
4,878,763 A 11/1989 Ausnit
4,890,637 A 1/1990 Lamparter
4,890,935 A 1/1990 Ausnit et al.
4,892,414 A 1/1990 Ausnit
4,903,718 A 2/1990 Sullivan
4,907,321 A 3/1990 Williams
4,909,017 A 3/1990 McMahon et al.
4,923,701 A 5/1990 VanErden
4,925,318 A 5/1990 Sorensen
4,928,829 A 5/1990 Di Bernardo
4,929,487 A 5/1990 Tilman et al.
4,930,904 A 6/1990 Gröner et al.
4,947,525 A 8/1990 Van Erden
4,953,708 A 9/1990 Beer et al.
4,961,944 A 10/1990 Matoba et al.
4,964,739 A 10/1990 Branson et al.
4,966,470 A 10/1990 Thompson et al.
4,985,192 A 1/1991 Roeder et al.
5,007,143 A 4/1991 Herrington
5,009,318 A 4/1991 Lepinoy
5,012,561 A 5/1991 Porchia et al.
5,017,021 A 5/1991 Simonsen et al.
5,022,530 A 6/1991 Zieke
RE33,674 E 8/1991 Uramoto

(56) References Cited

U.S. PATENT DOCUMENTS

| | | | |
|---|---|---|---|
| 5,037,138 | A | 8/1991 | McClintock et al. |
| 5,044,774 | A | 9/1991 | Bullard et al. |
| 5,053,091 | A | 10/1991 | Giljam et al. |
| 5,056,933 | A | 10/1991 | Kamp |
| 5,059,036 | A | 10/1991 | Richison et al. |
| 5,067,208 | A | 11/1991 | Herrington, Jr. et al. |
| 5,067,822 | A | 11/1991 | Wirth et al. |
| 5,070,584 | A | 12/1991 | Dais et al. |
| 5,088,162 | A | 2/1992 | Allan |
| 5,088,971 | A | 2/1992 | Herrington |
| 5,092,684 | A | 3/1992 | Weeks |
| 5,119,531 | A | 6/1992 | Berger et al. |
| 5,140,727 | A | 8/1992 | Dais et al. |
| 5,140,796 | A | 8/1992 | Pope |
| 5,141,577 | A | 8/1992 | Porchia et al. |
| 5,142,970 | A | 9/1992 | ErkenBrack |
| 5,167,454 | A | 12/1992 | Woods et al. |
| 5,168,586 | A | 12/1992 | Small |
| 5,170,990 | A | 12/1992 | Kamiya et al. |
| 5,174,658 | A | 12/1992 | Cook et al. |
| 5,179,767 | A | 1/1993 | Allan |
| 5,186,543 | A | 2/1993 | Cochran |
| 5,188,461 | A | 2/1993 | Sorensen |
| 5,189,764 | A | 3/1993 | Herrington et al. |
| 5,192,135 | A | 3/1993 | Woods et al. |
| 5,198,055 | A | 3/1993 | Wirth et al. |
| 5,203,458 | A | 4/1993 | Cornwell |
| 5,209,264 | A | 5/1993 | Koyanagi |
| 5,209,574 | A | 5/1993 | Tilman |
| 5,211,481 | A | 5/1993 | Tilman |
| 5,212,855 | A | 5/1993 | McGanty |
| 5,216,787 | A | 6/1993 | Custer et al. |
| 5,228,271 | A | 7/1993 | Wallace |
| 5,235,731 | A | 8/1993 | Anzai et al. |
| 5,238,306 | A | 8/1993 | Heintz et al. |
| 5,240,112 | A | 8/1993 | Newburger |
| 5,242,516 | A | 9/1993 | Custer et al. |
| 5,246,114 | A | 9/1993 | Underwood |
| 5,248,201 | A | 9/1993 | Kettner et al. |
| 5,252,281 | A | 10/1993 | Kettner et al. |
| 5,252,379 | A | 10/1993 | Kuribayashi et al. |
| 5,263,777 | A | 11/1993 | Domke |
| 5,272,794 | A | 12/1993 | Hamatani et al. |
| 5,283,932 | A | 2/1994 | Richardson et al. |
| RE34,554 | E | 3/1994 | Ausnit |
| 5,293,672 | A | 3/1994 | Tominaga et al. |
| 5,301,394 | A | 4/1994 | Richardson et al. |
| 5,301,395 | A | 4/1994 | Richardson et al. |
| 5,326,176 | A | 7/1994 | Domke |
| 5,332,095 | A | 7/1994 | Wu |
| 5,333,736 | A | 8/1994 | Kawamura |
| 5,339,602 | A | 8/1994 | Landers et al. |
| 5,339,959 | A | 8/1994 | Cornwell |
| 5,351,369 | A | 10/1994 | Swain |
| 5,351,828 | A | 10/1994 | Becker et al. |
| 5,354,133 | A | 10/1994 | Rapparini |
| 5,356,222 | A | 10/1994 | Kettner et al. |
| 5,366,294 | A | 11/1994 | Wirth et al. |
| 5,368,394 | A | 11/1994 | Scott et al. |
| 5,369,847 | A | 12/1994 | Naya et al. |
| 5,371,925 | A | 12/1994 | Sawatsky |
| 5,384,942 | A | 1/1995 | Siegel |
| 5,388,910 | A | 2/1995 | Koyanagi |
| 5,397,182 | A | 3/1995 | Gaible et al. |
| 5,399,022 | A | 3/1995 | Sheets |
| 5,403,094 | A | 4/1995 | Tomic |
| 5,407,087 | A | 4/1995 | Giblin et al. |
| RE34,929 | E | 5/1995 | Kristen |
| 5,415,904 | A | 5/1995 | Takubo et al. |
| 5,417,035 | A | 5/1995 | English |
| 5,417,495 | A | 5/1995 | Branson |
| 5,419,638 | A | 5/1995 | Jamison |
| 5,435,864 | A | 7/1995 | Machacek et al. |
| 5,443,851 | A | 8/1995 | Christie et al. |
| 5,445,870 | A | 8/1995 | Buchner et al. |
| 5,448,807 | A | 9/1995 | Herrington, Jr. |
| 5,450,963 | A | 9/1995 | Carson |
| 5,462,473 | A | 10/1995 | Sheller |
| 5,469,966 | A | 11/1995 | Boyer |
| 5,480,030 | A | 1/1996 | Sweeney et al. |
| 5,492,241 | A | 2/1996 | Barnett et al. |
| 5,494,165 | A | 2/1996 | Detrick |
| 5,509,734 | A | 4/1996 | Ausnit |
| 5,511,884 | A | 4/1996 | Bruno et al. |
| 5,520,463 | A | 5/1996 | Tilman |
| 5,523,236 | A | 6/1996 | Nuzzo |
| 5,525,363 | A | 6/1996 | Herber et al. |
| 5,526,843 | A | 6/1996 | Wolf et al. |
| 5,540,500 | A | 7/1996 | Tanaka |
| 5,540,557 | A | 7/1996 | Carson |
| 5,542,902 | A | 8/1996 | Richison et al. |
| 5,544,752 | A | 8/1996 | Cox |
| 5,549,944 | A | 8/1996 | Abate |
| 5,551,127 | A | 9/1996 | May |
| 5,553,942 | A | 9/1996 | Domke et al. |
| 5,554,423 | A | 9/1996 | Abate |
| 5,558,439 | A | 9/1996 | Tilman |
| 5,558,613 | A | 9/1996 | Tilman et al. |
| 5,566,429 | A | 10/1996 | Martinez et al. |
| 5,573,614 | A | 11/1996 | Tilman et al. |
| 5,577,305 | A | 11/1996 | Johnson |
| 5,584,409 | A | 12/1996 | Chemberlen |
| 5,587,192 | A | 12/1996 | Beizermann |
| 5,588,187 | A | 12/1996 | Swain |
| 5,592,697 | A | 1/1997 | Young |
| 5,603,995 | A | 2/1997 | Takubo et al. |
| 5,609,420 | A | 3/1997 | Palmisano |
| 5,618,111 | A | 4/1997 | Porchia et al. |
| 5,622,431 | A | 4/1997 | Simonsen |
| 5,628,566 | A | 5/1997 | Schreiter |
| 5,638,971 | A | 6/1997 | Justesen |
| 5,653,251 | A | 8/1997 | Handler |
| 5,655,273 | A | 8/1997 | Tomic et al. |
| 5,655,842 | A | 8/1997 | Hagino |
| 5,660,479 | A | 8/1997 | May et al. |
| 5,664,303 | A | 9/1997 | Johnson |
| 5,669,715 | A | 9/1997 | Dobreski et al. |
| 5,672,009 | A | 9/1997 | Malin |
| 5,689,866 | A | 11/1997 | Kasai et al. |
| 5,699,838 | A | 12/1997 | Catallo et al. |
| 5,700,091 | A | 12/1997 | Tanaka et al. |
| 5,701,996 | A | 12/1997 | Goto et al. |
| 5,709,479 | A | 1/1998 | Bell |
| 5,713,669 | A | 2/1998 | Thomas et al. |
| 5,718,024 | A | 2/1998 | Robbins |
| 5,729,876 | A | 3/1998 | Johnson |
| 5,735,317 | A | 4/1998 | Wu |
| 5,735,395 | A | 4/1998 | Lo |
| 5,749,493 | A | 5/1998 | Boone et al. |
| 5,749,658 | A | 5/1998 | Kettner |
| 5,769,772 | A | 6/1998 | Wiley |
| 5,774,954 | A | 7/1998 | Ramsey et al. |
| 5,775,812 | A | 7/1998 | St. Phillips et al. |
| 5,782,562 | A | 7/1998 | Anspacher |
| 5,782,733 | A | 7/1998 | Yeager |
| 5,784,862 | A | 7/1998 | Germano |
| 5,791,783 | A | 8/1998 | Porchia et al. |
| 5,794,315 | A | 8/1998 | Crabtree et al. |
| 5,827,163 | A | 10/1998 | Kettner |
| 5,829,884 | A | 11/1998 | Yeager |
| 5,833,791 | A | 11/1998 | Bryniarski et al. |
| 5,839,582 | A | 11/1998 | Strong et al. |
| 5,839,831 | A | 11/1998 | Mazzocchi |
| 5,839,832 | A | 11/1998 | Hagino |
| 5,855,498 | A | 1/1999 | Spector |
| 5,871,281 | A | 2/1999 | Stolmeier et al. |
| 5,874,155 | A | 2/1999 | Gehrke et al. |
| 5,875,611 | A | 3/1999 | Plourde |
| 5,881,881 | A | 3/1999 | Carrington |
| 5,882,120 | A | 3/1999 | Bell |
| 5,893,461 | A | 4/1999 | Walters |
| 5,893,645 | A | 4/1999 | May |
| 5,894,929 | A | 4/1999 | Kai et al. |
| 5,898,113 | A | 4/1999 | Vecere |

(56) References Cited

U.S. PATENT DOCUMENTS

| | | | |
|---|---|---|---|
| 5,902,046 | A | 5/1999 | Shibata |
| 5,902,047 | A | 5/1999 | Yeager |
| 5,911,508 | A | 6/1999 | Dobreski et al. |
| 5,915,596 | A | 6/1999 | Credle, Jr. |
| 5,919,535 | A | 7/1999 | Dobreski et al. |
| 5,924,173 | A | 7/1999 | Dobreski et al. |
| 5,924,795 | A | 7/1999 | Thompson et al. |
| 5,927,336 | A | 7/1999 | Tanaka et al. |
| 5,927,855 | A | 7/1999 | Tomic et al. |
| 5,928,762 | A | 7/1999 | Aizawa et al. |
| 5,930,877 | A | 8/1999 | Thorpe et al. |
| 5,931,189 | A | 8/1999 | Sweeney et al. |
| 5,931,582 | A | 8/1999 | Nichols |
| 5,933,927 | A | 8/1999 | Miller et al. |
| 5,941,421 | A | 8/1999 | Overman et al. |
| 5,941,643 | A | 8/1999 | Linkiewicz |
| 5,944,425 | A | 8/1999 | Forman |
| 5,947,603 | A | 9/1999 | Tilman |
| 5,951,453 | A | 9/1999 | Yeager |
| 5,953,796 | A | 9/1999 | McMahon et al. |
| 5,954,196 | A | 9/1999 | Lin |
| 5,954,433 | A | 9/1999 | Yeager |
| 5,956,815 | A | 9/1999 | O'Connor et al. |
| 5,964,532 | A | 10/1999 | St. Phillips et al. |
| 5,967,664 | A | 10/1999 | Giles et al. |
| 5,983,466 | A | 11/1999 | Petkovsek |
| 5,988,426 | A | 11/1999 | Stern |
| 5,988,880 | A | 11/1999 | Tomic |
| 5,989,608 | A | 11/1999 | Mizuno |
| 5,992,442 | A | 11/1999 | Urquhart et al. |
| 5,992,635 | A | 11/1999 | Walters |
| 5,996,800 | A | 12/1999 | Pratt |
| 6,004,032 | A | 12/1999 | Kapperman et al. |
| 6,009,603 | A | 1/2000 | Gallagher |
| 6,010,244 | A | 1/2000 | Dobreski et al. |
| 6,012,264 | A | 1/2000 | Linkiewicz |
| 6,014,795 | A | 1/2000 | McMahon et al. |
| 6,017,412 | A | 1/2000 | Van Erden et al. |
| 6,019,512 | A | 2/2000 | Yeager |
| 6,021,624 | A | 2/2000 | Richison et al. |
| 6,023,914 | A | 2/2000 | Richison et al. |
| 6,029,810 | A | 2/2000 | Chen |
| 6,030,122 | A | 2/2000 | Ramsey et al. |
| 6,033,113 | A | 3/2000 | Anderson |
| 6,039,182 | A | 3/2000 | Light |
| 6,044,621 | A | 4/2000 | Malin et al. |
| 6,045,264 | A | 4/2000 | Miniea |
| 6,045,546 | A | 4/2000 | Drago et al. |
| 6,047,450 | A | 4/2000 | Machacek et al. |
| 6,056,439 | A | 5/2000 | Graham |
| 6,059,456 | A | 5/2000 | May |
| 6,059,457 | A | 5/2000 | Sprehe et al. |
| 6,068,898 | A | 5/2000 | Oyama |
| 6,070,397 | A | 6/2000 | Bachhuber |
| 6,070,728 | A | 6/2000 | Overby et al. |
| 6,071,011 | A | 6/2000 | Thomas et al. |
| 6,074,096 | A | 6/2000 | Tilman |
| 6,076,967 | A | 6/2000 | Beaudette |
| 6,080,252 | A | 6/2000 | Plourde |
| 6,082,897 | A | 7/2000 | Galomb |
| 6,085,906 | A | 7/2000 | Lambert |
| 6,085,922 | A | 7/2000 | Esser |
| 6,092,931 | A | 7/2000 | Tilman |
| 6,110,586 | A | 8/2000 | Johnson |
| 6,112,374 | A | 9/2000 | Van Erden |
| 6,116,781 | A | 9/2000 | Skeens |
| 6,120,817 | A | 9/2000 | Archibald et al. |
| 6,126,013 | A | 10/2000 | Miller |
| 6,126,975 | A | 10/2000 | Archibald et al. |
| 6,132,089 | A | 10/2000 | Galomb et al. |
| 6,138,329 | A | 10/2000 | Johnson |
| 6,148,588 | A | 11/2000 | Thomas et al. |
| 6,149,302 | A | 11/2000 | Taheri |
| 6,149,304 | A | 11/2000 | Hamilton et al. |
| 6,152,601 | A | 11/2000 | Johnson |
| 6,164,825 | A | 12/2000 | Larkin et al. |
| 6,167,597 | B1 | 1/2001 | Malin |
| 6,170,985 | B1 | 1/2001 | Shabram, Jr. et al. |
| 6,176,613 | B1 | 1/2001 | Chen |
| 6,177,172 | B1 | 1/2001 | Yeager |
| 6,178,602 | B1 | 1/2001 | Burke et al. |
| 6,182,337 | B1 | 2/2001 | Machacek et al. |
| 6,182,850 | B1 | 2/2001 | Marbler et al. |
| 6,185,796 | B1 | 2/2001 | Ausnit |
| 6,194,011 | B1 | 2/2001 | Glaser |
| 6,202,849 | B1 | 3/2001 | Graham |
| 6,209,287 | B1 | 4/2001 | Thieman |
| 6,217,216 | B1 | 4/2001 | Taheri |
| 6,220,754 | B1 | 4/2001 | Stiglic et al. |
| 6,224,262 | B1 | 5/2001 | Hogan et al. |
| 6,227,706 | B1 | 5/2001 | Tran |
| 6,231,236 | B1 | 5/2001 | Tilman |
| 6,240,941 | B1 | 6/2001 | Small et al. |
| 6,244,021 | B1 | 6/2001 | Ausnit et al. |
| 6,244,748 | B1 | 6/2001 | Kasai et al. |
| 6,257,763 | B1 | 7/2001 | Stolmeier et al. |
| 6,270,257 | B1 | 8/2001 | Yeager |
| 6,273,609 | B1 | 8/2001 | Johnson |
| 6,274,181 | B1 | 8/2001 | Richison et al. |
| 6,279,298 | B1 | 8/2001 | Thomas et al. |
| 6,286,191 | B2 | 9/2001 | Van Erden |
| 6,286,999 | B1 | 9/2001 | Cappel et al. |
| 6,287,001 | B1 | 9/2001 | Buchman |
| 6,289,561 | B1 | 9/2001 | Provan et al. |
| 6,290,391 | B1 | 9/2001 | Buchman |
| 6,290,392 | B1 | 9/2001 | Sandor |
| 6,292,986 | B1 | 9/2001 | Provan et al. |
| 6,293,701 | B1 | 9/2001 | Tomic |
| 6,299,353 | B1 | 10/2001 | Piechocki et al. |
| 6,299,720 | B1 | 10/2001 | Van Erden |
| 6,317,939 | B1 | 11/2001 | Malin |
| 6,321,423 | B1 | 11/2001 | Johnson |
| 6,334,711 | B1 | 1/2002 | Risgalla et al. |
| 6,345,911 | B1 | 2/2002 | Young et al. |
| 6,347,437 | B2 | 2/2002 | Provan et al. |
| 6,354,738 | B1 | 3/2002 | Buckman et al. |
| 6,357,915 | B2 | 3/2002 | Anderson |
| 6,361,209 | B1 | 3/2002 | LaRue et al. |
| 6,361,211 | B1 | 3/2002 | Tilman |
| 6,361,212 | B1 | 3/2002 | Sprehe et al. |
| 6,364,530 | B1 | 4/2002 | Buchman |
| 6,371,643 | B2 | 4/2002 | Saad et al. |
| 6,371,644 | B1 | 4/2002 | Forman |
| 6,374,855 | B1 | 4/2002 | Hansen |
| 6,376,035 | B1 | 4/2002 | Dobreski et al. |
| 6,378,272 | B1 | 4/2002 | Archibald et al. |
| 6,385,818 | B1 | 5/2002 | Savicki, Sr. |
| 6,386,760 | B1 | 5/2002 | Tomic |
| 6,402,375 | B1 | 6/2002 | Schreiter et al. |
| 6,403,174 | B1 | 6/2002 | Copeta |
| 6,408,872 | B1 | 6/2002 | Skeens et al. |
| 6,439,771 | B1 | 8/2002 | Herrington, Jr. |
| 6,450,686 | B1 | 9/2002 | May |
| 6,461,042 | B1 | 10/2002 | Tomic et al. |
| 6,468,332 | B2 | 10/2002 | Goglio et al. |
| 6,481,889 | B2 | 11/2002 | Delsahut |
| 6,481,890 | B1 | 11/2002 | VandenHeuvel |
| 6,487,758 | B2 | 12/2002 | Shaffer et al. |
| 6,489,022 | B1 | 12/2002 | Hamilton et al. |
| 6,491,166 | B1 | 12/2002 | Compton et al. |
| 6,491,433 | B2 | 12/2002 | Shabram, Jr. et al. |
| 6,499,878 | B1 | 12/2002 | Dobreski et al. |
| 6,499,879 | B2 | 12/2002 | Schneck |
| 6,505,383 | B2 | 1/2003 | Machacek et al. |
| 6,513,659 | B1 | 2/2003 | Ogura et al. |
| 6,517,242 | B1 | 2/2003 | Buchman |
| 6,524,002 | B2 | 2/2003 | Tomic |
| 6,526,632 | B1 | 3/2003 | Blythe et al. |
| 6,527,003 | B1 | 3/2003 | Webster |
| 6,530,870 | B2 | 3/2003 | Buchman et al. |
| 6,533,456 | B1 | 3/2003 | Buchman |
| D473,761 | S | 4/2003 | Wilk et al. |
| 6,539,594 | B1 | 4/2003 | Kasai et al. |
| 6,550,965 | B2 | 4/2003 | Shaffer et al. |

(56) References Cited

U.S. PATENT DOCUMENTS 6,568,046 B1 5/2003 Savicki et al.
6,571,430 B1 6/2003 Savicki et al.
6,572,267 B1 6/2003 Forman
6,575,191 B2 6/2003 Skeens et al.
6,581,253 B2 6/2003 ErkenBrack
6,581,641 B2 6/2003 Skeens et al.
6,595,689 B1 7/2003 Borchardt et al.
D478,774 S 8/2003 Wilk et al.
6,602,580 B1 8/2003 Hamilton et al.
6,604,634 B2 8/2003 Su
6,609,353 B1 8/2003 McMahon et al.
6,609,827 B2 8/2003 Bois et al.
6,611,996 B2 9/2003 Blythe et al.
6,622,857 B2 9/2003 Ohtsubo et al.
6,632,021 B2 10/2003 Bois et al.
6,634,384 B2 10/2003 Skeens et al.
6,637,939 B2 10/2003 Huffer
6,659,643 B2 12/2003 Plourde et al.
6,662,827 B1 12/2003 Clougherty et al.
6,663,284 B2 12/2003 Buckingham et al.
6,666,580 B2 12/2003 Bois
6,675,982 B2 1/2004 Heil et al.
6,679,027 B2 1/2004 Schreiter
6,691,383 B2 2/2004 Linton
6,692,147 B2 2/2004 Nelson
6,694,704 B1 2/2004 Ausnit
6,698,925 B2 3/2004 Bentsen
6,712,334 B2 3/2004 Motonaka et al.
6,712,509 B2 3/2004 Cappel
6,713,152 B2 3/2004 Chen et al.
6,715,644 B2 4/2004 Wilford
6,721,999 B2 4/2004 Meager
6,729,473 B2 5/2004 Anderson
6,739,755 B2 5/2004 Schreiter
6,755,568 B2 6/2004 Malone et al.
6,767,131 B2 7/2004 Taheri
6,773,163 B2 8/2004 Ichikawa et al.
6,780,146 B2 8/2004 Thomas et al.
6,786,641 B2 9/2004 Plourde
6,789,690 B2 9/2004 Nieh et al.
6,796,933 B2 9/2004 Bois
6,799,680 B2 10/2004 Mak
6,799,890 B2 10/2004 Schneider et al.
6,810,642 B2 11/2004 Cortigiano, Sr.
6,817,763 B2 11/2004 Tomic
6,821,589 B2 11/2004 Dobreski et al.
6,826,808 B2 12/2004 Kutschka
6,827,105 B1 12/2004 Marble et al.
6,827,492 B2 12/2004 Cook
6,830,377 B2 12/2004 Schneider
6,835,257 B2 12/2004 Perrine
6,837,268 B2 1/2005 Skeens et al.
6,845,598 B1 1/2005 Melchoir
6,846,107 B2 1/2005 Sweeney et al.
6,851,248 B2 2/2005 Knight et al.
6,854,886 B2 2/2005 Piechocki et al.
6,862,980 B2 3/2005 Heil et al.
6,874,935 B2 4/2005 Edelman et al.
6,874,937 B2 4/2005 Ausnit
6,874,938 B2 4/2005 Price et al.
6,877,898 B2 4/2005 Berich et al.
6,883,665 B1 4/2005 Ahn
6,884,207 B2 4/2005 Pokusa
6,901,637 B2 6/2005 Machacek
6,910,805 B2 6/2005 Johnson
6,910,806 B2 6/2005 Strand et al.
6,913,387 B2 7/2005 Strand et al.
6,925,688 B1 8/2005 Savicki
6,932,509 B2 8/2005 Shah et al.
6,945,392 B2 9/2005 Furukawa et al.
6,954,969 B1 10/2005 Sprehe
6,955,465 B2 10/2005 Machacek et al.
6,964,519 B2 11/2005 ErkenBrack
6,974,256 B2 12/2005 Kinigakis et al.
6,976,669 B2 12/2005 Van Zijll Langhout et al.
6,983,845 B2 1/2006 Shah et al.
6,984,278 B2 1/2006 Anderson et al.
6,988,828 B2 1/2006 Linneweil
6,991,109 B1 1/2006 Shannon et al.
6,993,886 B2 2/2006 Johnson
6,996,879 B1 2/2006 Savicki
7,004,209 B2 2/2006 Davis et al.
7,004,632 B2 2/2006 Hamilton et al.
7,011,615 B2 3/2006 Price et al.
7,022,058 B2 4/2006 Lee
7,036,988 B2 5/2006 Olechowski
7,048,136 B2 5/2006 Havens et al.
7,051,762 B2 5/2006 Haamer
7,077,570 B2 7/2006 Fukumori et al.
7,087,130 B2 8/2006 Wu et al.
7,090,397 B2 8/2006 Stolmeier
7,090,398 B2 8/2006 Shibata
7,096,893 B2 8/2006 Vilalta et al.
7,097,359 B2 8/2006 Plourde et al.
7,108,147 B2 9/2006 Cheung
7,131,550 B2 11/2006 Vilalta et al.
7,138,025 B2 11/2006 Wu et al.
7,162,779 B2 1/2007 MacHacek
7,163,338 B2 1/2007 McCracken et al.
7,178,555 B2 2/2007 Engel et al.
7,461,434 B2 12/2008 Ackerman
7,574,781 B2 8/2009 Ackerman et al.
7,784,160 B2 8/2010 Dais et al.
8,176,604 B2 * 5/2012 Dais et al. ..... 24/585.12
2001/0034999 A1 11/2001 Xiong et al.
2002/0090151 A1 7/2002 Skeens et al.
2002/0097923 A1 7/2002 Dobreski et al.
2002/0124471 A1 9/2002 Anderson et al.
2002/0168118 A1 11/2002 Price
2002/0168119 A1 11/2002 Herrington, Jr.
2003/0016887 A1 1/2003 Su
2003/0024847 A1 2/2003 Malaspina
2003/0053722 A1 3/2003 Eggermont
2003/0095727 A1 5/2003 Leighton
2003/0102245 A1 6/2003 Wang
2003/0116466 A1 6/2003 Goto
2003/0118253 A1 6/2003 Machacek
2003/0136798 A1 7/2003 Wilford
2003/0169948 A1 9/2003 Fenzl et al.
2003/0219174 A1 11/2003 Piechocki
2003/0219177 A1 11/2003 Salvaro
2003/0223654 A1 12/2003 Gerrits
2004/0000336 A1 1/2004 Goglio
2004/0000503 A1 1/2004 Shah et al.
2004/0001651 A1 1/2004 Pawloski
2004/0007494 A1 1/2004 Popeil et al.
2004/0014579 A1 1/2004 Sweeney et al.
2004/0022457 A1 2/2004 Brown et al.
2004/0040961 A1 3/2004 Vilalta et al.
2004/0049896 A1 3/2004 Savicki
2004/0050745 A1 3/2004 Lee et al.
2004/0057636 A1 3/2004 Ishizaki
2004/0078939 A1 4/2004 Pawloski
2004/0081375 A1 4/2004 Pokusa
2004/0091185 A1 5/2004 Shibata
2004/0091186 A1 5/2004 Shibata
2004/0098845 A1 5/2004 Fukumori et al.
2004/0114837 A1 6/2004 Koyanagi
2004/0136617 A1 7/2004 Gerrits
2004/0136618 A1 7/2004 Ausnit et al.
2004/0165794 A1 8/2004 Plourde et al.
2004/0177595 A1 9/2004 Kozak
2004/0208400 A1 10/2004 Linneweil
2004/0211698 A1 10/2004 John Mak
2004/0223667 A1 11/2004 Shah et al.
2004/0234170 A1 11/2004 Pawloski et al.
2004/0252915 A1 12/2004 Nelson
2004/0256050 A1 12/2004 Wu
2005/0008266 A1 1/2005 Crunkleton et al.
2005/0022472 A1 2/2005 Brakes et al.
2005/0025394 A1 2/2005 Kinigakis et al.
2005/0029704 A1 2/2005 Wu et al.
2005/0034425 A1 2/2005 Johnson
2005/0034806 A1 2/2005 Wu et al.

(56) References Cited

U.S. PATENT DOCUMENTS

| | | | |
|---|---|---|---|
| 2005/0034807 | A1 | 2/2005 | Wu et al. |
| 2005/0035020 | A1 | 2/2005 | Wu et al. |
| 2005/0036717 | A1 | 2/2005 | Wu et al. |
| 2005/0036718 | A1 | 2/2005 | Wu et al. |
| 2005/0036719 | A1 | 2/2005 | Wu et al. |
| 2005/0037164 | A1 | 2/2005 | Wu et al. |
| 2005/0061812 | A1 | 3/2005 | Vilalta et al. |
| 2005/0063620 | A1 | 3/2005 | Anderson |
| 2005/0065007 | A1 | 3/2005 | Wu et al. |
| 2005/0069229 | A1 | 3/2005 | McCracken et al. |
| 2005/0103798 | A1 | 5/2005 | Luigi |
| 2005/0135710 | A1 | 6/2005 | Melchoir |
| 2005/0147330 | A1 | 7/2005 | Lee |
| 2005/0172577 | A1 | 8/2005 | Oltrogge |
| 2005/0190995 | A1 | 9/2005 | Koyanagi |
| 2005/0196076 | A1 | 9/2005 | Tanaka et al. |
| 2005/0205455 | A1 | 9/2005 | Harrison |
| 2005/0220373 | A1 | 10/2005 | Wu |
| 2005/0220374 | A1 | 10/2005 | Thomas et al. |
| 2005/0229365 | A1 | 10/2005 | Offa-Jones |
| 2005/0235468 | A1 | 10/2005 | Borchardt et al. |
| 2005/0238263 | A1 | 10/2005 | Ping |
| 2005/0244083 | A1 | 11/2005 | McMahon et al. |
| 2005/0245376 | A1 | 11/2005 | Savicki et al. |
| 2005/0251973 | A1 | 11/2005 | Sprehe |
| 2005/0259895 | A1 | 11/2005 | Kozak |
| 2005/0271308 | A1 | 12/2005 | Pawloski |
| 2005/0276524 | A1 | 12/2005 | Taheri |
| 2005/0281489 | A1 | 12/2005 | Yeh et al. |
| 2005/0281490 | A1 | 12/2005 | Schneider et al. |
| 2005/0281493 | A1 | 12/2005 | Heinemeier et al. |
| 2005/0281494 | A1 | 12/2005 | Allen et al. |
| 2005/0282695 | A1 | 12/2005 | Yeager |
| 2005/0286808 | A1 | 12/2005 | Zimmerman et al. |
| 2005/0286810 | A1 | 12/2005 | Sprague et al. |
| 2005/0286811 | A1 | 12/2005 | Sprague et al. |
| 2005/0286812 | A1 | 12/2005 | Sprague et al. |
| 2005/0286813 | A1 | 12/2005 | Borchardt |
| 2005/0286817 | A1 | 12/2005 | Hall et al. |
| 2006/0008185 | A1 | 1/2006 | Borchardt |
| 2006/0008187 | A1 | 1/2006 | Armstrong |
| 2006/0013514 | A1 | 1/2006 | Wu |
| 2006/0029299 | A1 | 2/2006 | Share et al. |
| 2006/0030472 | A1 | 2/2006 | Hartman et al. |
| 2006/0034551 | A1 | 2/2006 | Linneweil |
| 2006/0035777 | A1 | 2/2006 | Johnson |
| 2006/0048483 | A1 | 3/2006 | Tilman et al. |
| 2006/0050999 | A1 | 3/2006 | Blythe et al. |
| 2006/0053749 | A1 | 3/2006 | Scanlan |
| 2006/0072860 | A1 | 4/2006 | Wu |
| 2006/0073291 | A1 | 4/2006 | Wu |
| 2006/0076058 | A1 | 4/2006 | Rypstra |
| 2006/0093242 | A1 | 5/2006 | Anzini et al. |
| 2006/0104548 | A1 | 5/2006 | Schreiter |
| 2006/0110079 | A1 | 5/2006 | Zimmerman et al. |
| 2006/0111226 | A1 | 5/2006 | Anzini et al. |
| 2006/0120632 | A1 | 6/2006 | Han |
| 2006/0131328 | A1 | 6/2006 | Anderson |
| 2006/0157140 | A1 | 7/2006 | Bergman et al. |
| 2006/0159372 | A1 | 7/2006 | Plourde et al. |
| 2006/0159576 | A1 | 7/2006 | Bergman et al. |
| 2006/0165316 | A1 | 7/2006 | Cheung |
| 2006/0177156 | A1 | 8/2006 | Owen et al. |
| 2006/0179620 | A1 | 8/2006 | MacHacek |
| 2006/0182371 | A1 | 8/2006 | Borchardt |
| 2006/0193540 | A1 | 8/2006 | Borchardt |
| 2006/0201576 | A1 | 9/2006 | Domenig |
| 2006/0225787 | A1 | 10/2006 | Newrones et al. |
| 2006/0228057 | A1 | 10/2006 | Newrones et al. |
| 2006/0263497 | A1 | 11/2006 | Hoffman |
| 2006/0283148 | A1 | 12/2006 | Zimmermann et al. |
| 2006/0292322 | A1 | 12/2006 | Nakajima et al. |
| 2007/0090109 | A1 | 4/2007 | Gustavsson |
| 2007/0130733 | A1 | 6/2007 | Kasai |
| 2007/0154118 | A1 | 7/2007 | Tilman et al. |
| 2007/0172157 | A1 | 7/2007 | Buchman |

* cited by examiner

POUCH AND AIRTIGHT RESEALABLE CLOSURE MECHANISM THEREFOR

CROSS REFERENCE TO RELATED APPLICATIONS

This application is a divisional of U.S. patent application Ser. No. 11/725,120, filed Mar. 16, 2007, which issued as U.S. Pat. No. 7,886,412 on Feb. 15, 2011, and which is hereby incorporated by reference herein in its entirety.

REFERENCE REGARDING FEDERALLY SPONSORED RESEARCH OR DEVELOPMENT

Not applicable.

SEQUENTIAL LISTING

Not applicable.

BACKGROUND OF THE INVENTION

1. Field of the Invention

The present invention relates generally to a resealable closure mechanism, such as may be used on a thermoplastic pouch.

2. Description of the Background of the Invention

Thermoplastic pouches having one or more resealable closure mechanisms extending along an opening into an interior thereof are often used to store perishable contents, such as food. In order to keep the food stored inside the pouch fresh for an extended period, users may press excess air out of the bag before completely sealing the closure mechanism. Other pouches have been developed that have a separate air evacuation route so that air may be removed from the pouch after the closure mechanism has already been sealed. Some such pouches allow a vacuum to be formed inside the pouch and then be sealed so as to vacuum pack the contents of the pouch.

Special resealable closure mechanisms have been used in an attempt to maintain the vacuum in the pouch over extended periods of time. Those closure mechanisms include two opposing closure elements that form an interlocking section and a sealing section in an attempt to form an airtight seal. For example, in some such closure mechanisms, one closure element includes a sealing member spaced between two in-turned hooks and the other closure element includes a channel defined by and between two out-turned hooks. The sealing member abuts against inside surfaces of the out-turned hooks to form a seal therewith.

In other such closure mechanisms, each closure element includes a sealing member disposed between two interlocking members. The sealing members press against each other when the interlocking members are appropriately interlocked, to form the seal. In one closure mechanism, for example, one closure element includes two spaced out-turned male hooks that interlock with two complementary in-turned female hooks. A pressing rib spaced between the out-turned male hooks is wedged into a tapered channel defined by two tightening walls spaced between the in-turned female hooks. Each tightening wall also presses against an inner surface of the adjacent out-turned male hook.

In another closure mechanism, one closure element has two interlocking bulbous members spaced between two asymmetrical arrow-shaped members projecting from one base. The other closure element has three interlocking bulbous members spaced between two interlocking groove elements projecting from another base. The closure elements resealably mate with each asymmetrical arrow-shaped member interlocked with the opposing groove element and the two interlocking bulbous members on the one closure element engage in a tight interfering fit between successive ones of the interlocking bulbous members on the other closure element, sufficient to form a vacuum seal therebetween. One of the closure elements has a backing member that may be attached directly to a bag wall, and the other closure element has a backing member that is attached at only one end to another flange element that may be attached directly to a bag wall.

SUMMARY OF THE INVENTION

According to one aspect of the invention, an airtight resealable closure mechanism, having an elongate profile extending between a first end and a second end, includes a first closure element and a second closure element. The first closure element has a first interlocking member, a second interlocking member, and a first sealing member, each protruding from a first base member. The first sealing member is disposed between the first and second interlocking members. The second closure element has a third interlocking member, a fourth interlocking member, and a second sealing member, each protruding from a second base member. The second sealing member forms a tapered channel and is disposed between the third and fourth interlocking members. The first and second interlocking members are resealably interlocked with the third and fourth interlocking members, respectively, and the first sealing member is wedged into the tapered channel of the second sealing member, wherein an airtight seal is formed. The first and second sealing members are spaced from each of the first, second, third, and fourth, interlocking members.

According to another aspect of the invention, a resealable airtight closure mechanism includes a first elongate profile resealably interlocked with a second elongate profile, wherein each elongate profile extends longitudinally between two ends. The first profile includes a first sealing wall spaced between an arrow-shaped first male interlocking member and a channel-shaped first female interlocking member, each projecting from one side of a first base member. The second profile includes a first sealing rib and a second sealing rib spaced between a channel-shaped second female interlocking member and an arrow-shaped second male interlocking member, each projecting from one side of a second base member. Each sealing rib includes a bulbous head spaced from the first base member. The first male interlocking member is interlocked with the second female interlocking member and the first female interlocking member is interlocked with the second male interlocking member. Also, the sealing wall is wedged between the first sealing rib and the second sealing rib, whereby an airtight seal is formed between the sealing wall and each bulbous head.

According to yet another aspect of the present invention, a resealable pouch includes a front panel connected with a back panel along a peripheral edge to define a sealable interior space therebetween, and an opening is defined between the front and back panels along a top edge. A first elongate closure profile extends along the front panel proximate to the opening, and a second elongate closure profile extends along the back panel proximate to the opening. The first closure profile is releasably interlockable with the second closure profile, to seal and to unseal the opening. Further, the first closure profile includes a sealing member spaced between a first interlocking member and a second interlocking member, and the second closure profile comprises a second sealing member spaced between a third interlocking member and a fourth interlocking member. The first sealing member is sealingly engaged with the second sealing member, and the first and second interlocking members are interlocked with the third and fourth interlocking members, respectively. The first closure profile is continuously connected to the front panel between the first interlocking member and the second interlocking member, and the second closure profile is continuously connected to the back panel between the third interlocking member and the second sealing member. The second closure profile is not connected to the back panel proximate to the fourth interlocking member.

Other aspects and advantages of the present invention will become apparent upon consideration of the following detailed description.

DETAILED DESCRIPTION

Figure 1:
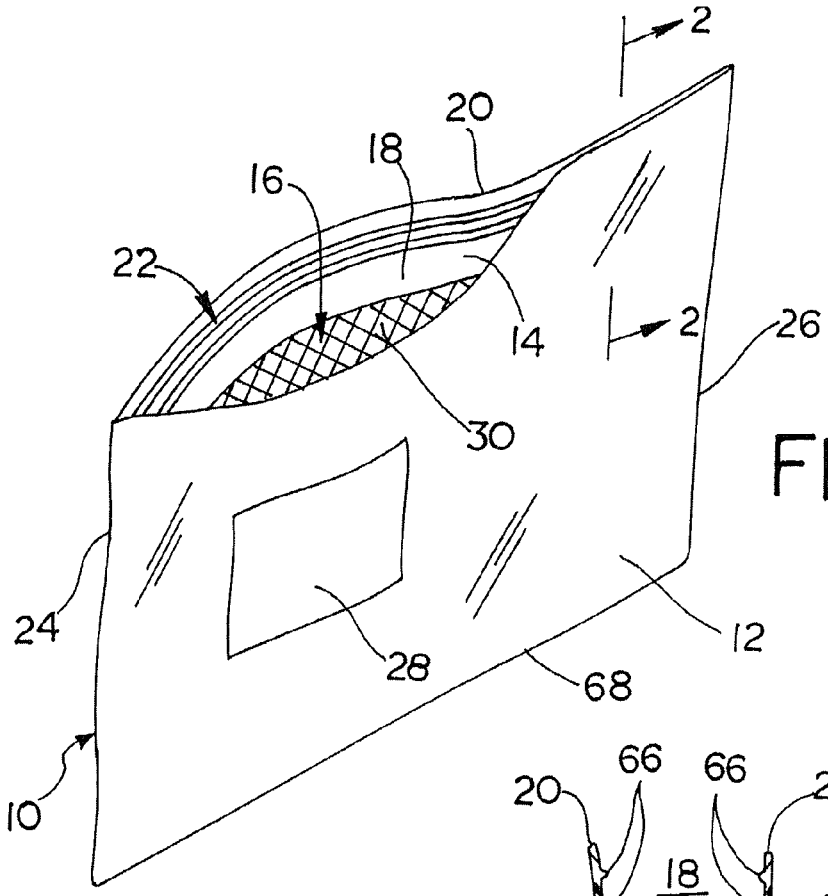
FIG. 1 is an isometric view of a pouch and an airtight closure mechanism according to one aspect of the present invention.
Figure 2:
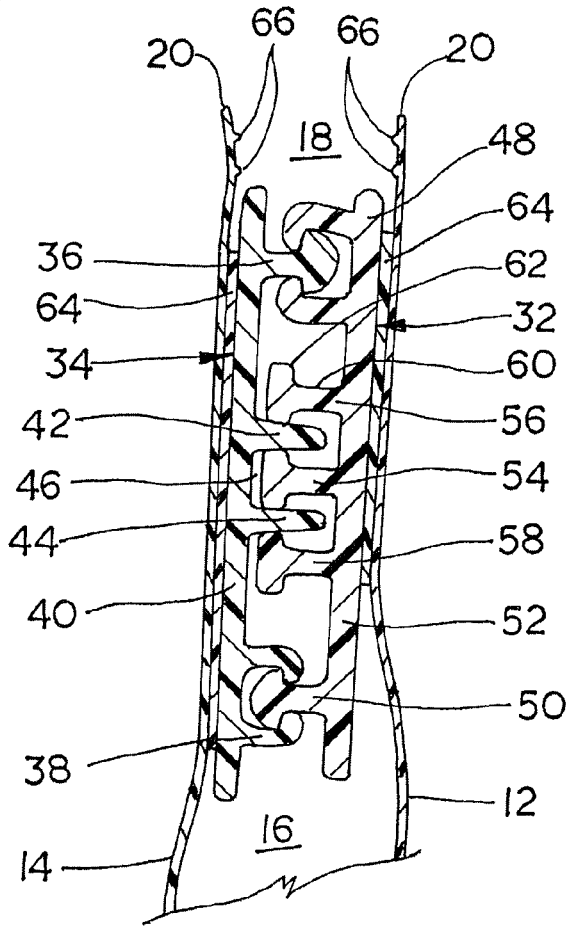
FIG. 2 is a partial cross-sectional view along the line 2-2 of FIG. 1 with portions behind the plane of the cross section omitted for clarity.

As seen in FIGS. 1 and 2, a resealable pouch 10 includes a front panel 12 and a back panel 14 that are connected, such as by folding, heat seal, and/or adhesive, along three peripheral edges to define a sealable interior space 16 therebetween, and an opening 18 is defined along a top edge 20 where the front and back panels are not connected so as to allow access to the interior space. A resealable elongate closure mechanism 22 extends along the front and back panels 12, 14 near the opening 18 between a left edge 24 and a right edge 26 of the pouch 10, to allow the opening to be repeatedly sealed and unsealed, thereby closing and opening, respectively, the opening. Preferably, the closure mechanism 22 provides an airtight seal such that a vacuum may be maintained in the interior space 16 for an extended period of time, such as days, months, or years, when the closure mechanism is sealed fully across the opening 18. In one embodiment, the pouch 10 may include a second opening through one of the panels 12, 14 covered by a vacuum check valve 28 to allow air to be evacuated from the interior space 16 and to maintain the vacuum when the closure mechanism 22 has been sealed. The pouch 10 may also include a relief on or along an interior surface of one or both of the front and back panels 12, 14 to provide air flow channels 30 between the panels when a vacuum is being drawn through the check valve 28. In this manner, the pouch 10 provides a complete evacuable system within which food, for example, may be stored in a reusable vacuum pouch.

As best seen in FIG. 2, the closure mechanism 22 includes a closure element 32 that releasably interlocks and seals with an opposing closure element 34. Each closure element 32, 34 has a substantially constant elongate cross-sectional profile that extends longitudinally between the left edge 24 and right edge 26 of the pouch 10 to form a continuous seal therealong when fully interlocked with the opposing closure element. In one embodiment, closure element 32 is disposed along the front panel 12 and the closure element 34 is disposed along the back panel 14 opposite to the first closure element, so as to resealably interlock along an entire length thereof.

The closure element 34 has an elongate closure profile including a sealing section spaced between two interlocking members 36, 38, each projecting from a common side of a base member 40. In one embodiment, the interlocking member 36 has an arrow-shaped male interlocking profile, and the interlocking member 38 has a channel-shaped female interlocking profile. The arrow-shaped male interlocking profile 36 includes a shaft extending outwardly from the base member 40 and a symmetrical head with barbs extending from opposite sides of a distal end of the shaft spaced from the base member. The channel-shaped female interlocking profile 38 includes two spaced arms extending from the base member 40, each arm having an in-turned hook at a distal end thereof, to form a channel therebetween. The sealing section of the closure element 34 includes a sealing wall 42 and a sealing wall 44 spaced apart and projecting outwardly from the base member 40. The sealing walls 42, 44 in one embodiment are tapered, having a tip that is narrower than a base, thereby forming a tapered channel 46 therebetween. In one embodiment, the sealing walls 42, 44 and the male and female interlocking profiles 36, 38 are all approximately the same height from the base member 40.

The closure element 32 has an elongate second closure profile including a sealing section spaced between two interlocking members 48, 50, each projecting from a common side of a base member 52. In one embodiment, the interlocking member 48 has a channel-shaped female interlocking profile, and the interlocking member 50 has an arrow-shaped male profile, complementary with the respective male and female interlocking profiles 36, 38, respectively, of the closure profile 34. The sealing section of the closure element 32 includes at least one sealing rib that wedges into the tapered channel 46 between the opposing sealing walls 42, 44. In one embodiment, the sealing section includes a first sealing rib 54 disposed between a second sealing rib 56 and a third sealing rib 58. Each sealing rib 54, 56, 58 has a bulbous head 60, such as a cross member, spaced from the base member 52 proximate to a distal end of a wall 62, which projects from the base member 52. In one embodiment, each sealing rib 54, 56, 58 has a T-shaped cross section. In other embodiments, the bulbous head 60 may have other shapes that project laterally from the wall 62, such as rounded, asymmetrical, slanted, or multiple projections, for example.

In a sealed state, the male interlocking profile 50 is interlocked with the female interlocking profile 38, and the female interlocking profile 48 is interlocked with the male interlocking profile 36. The bulbous head 60 of the sealing rib 54 is wedged tightly into the tapered channel 46 against the sealing walls 42, 44. The sealing wall 42 is wedged tightly between and against the bulbous heads 60 of the sealing rib 54 and the sealing rib 56, and the sealing wall 44 is wedged tightly between and against the bulbous heads 60 of the sealing rib 54 and the sealing rib 58. Preferably, the geometry of the sealing walls 42, 44 and the sealing ribs 54, 56, 58 is such that, when the interlocking profiles 36, 38, 48, 50 are occluded together in the sealed state, the distal ends of the sealing walls are spaced from the base member 52 and the bulbous heads 60 are spaced from the base member 40, thereby ensuring four air tight seals across the closure profiles 32, 34 between the interlocking profiles 36, 48 and 38, 50. Further, the sealing sections are spaced from each interlocking member 36, 38, 48, 50, which provides a sealing section that forms an air tight seal independently of the interlocking members. Of course, more or fewer sealing walls and sealing ribs may be used in other embodiments to form more or fewer air tight seals across the closure profiles.

In order to develop differential opening and closing forces, one of the closure elements may be secured continuously to the respective panel along the entire profile of the base member, and the other closure element may be secured partially to the respective panel along only a portion of the profile. For example, in one embodiment, the closure element 34 is connected with the back panel 14 continuously between the interlocking member 36 and the interlocking member 38. The closure element 32 is connected with the front panel 12 continuously between the interlocking member 48 and an interior side of the sealing rib 58, and an interior end of the closure element 32 is unconnected with the front panel 12 between the interior end of the base 52 and the interior side of the sealing rib 58. In this manner, differential opening and closing forces may be developed, because the interior end and interlocking profile 50 of the base 52 of at least the closure element 32 is allowed to hinge away from the front panel 12, thereby minimizing an opening force caused by the contents pushing outwardly against the front and back panels 12, 14. In other embodiments, the interior end of either or both closure profiles 32, 34 may be unconnected with the respective panel 12 or 14, or the interior end of both closure profiles may be connected with the respective panel.

The closure elements 32, 34 may be connected with the respective front and back panels 12, 14 by many means, such as with adhesives or heat or ultrasonic welding. In one embodiment, the closure elements 32, 34 are connected with the respective panels 12, 14 using an intermediate layer 64 of connecting material, such as thermoplastic weld material, disposed between and connecting the base member 40, 52 of the closure element with the respective panel 14, 12. In this embodiment, a hot layer of thermoplastic weld material 64 applied between each closure element 32, 34 and the respective panel 12, 14 melts and attaches to both the panel and the base member, thereby forming a thermoplastic weld therebetween, which, in some embodiments, may provide a good continuous air tight seal between each panel and the respective closure member.

In one embodiment, the top edge 20 of one or both of the front and back panels 12, 14 extends upwardly beyond an exterior end of the respective closure profile 32, 34. One or more grip ridges 66 project from an interior side of one or both of the panels 12, 14 between the top edge 20 and the respective closure member 32, 34 to provide additional finger traction for opening the closure mechanism.

In a further embodiment, one or both of the closure elements 32, 34 may include one or more textured portions, such as a bump or crosswise groove in one or both of the interlocking members 36, 48, in order to provide a tactile sensation, such as a series of clicks, as a user draws the fingers along the closure mechanism to signify sealing of the closure elements across the opening. In another embodiment, all of the closure elements 36, 38, 48, 50 include textured portions along the length of the profile to provide tactile and/or audible sensations when closing the closure mechanism 22.

In one embodiment, the front and back panels 12, 14 and closure mechanism 22 are formed by known extrusion methods. For example, the panels 12, 14 may be extruded of thermoplastic material as a continuous single- or multi-ply web, and the closure profiles 32, 34 may be extruded of the same or different thermoplastic material separately as continuous lengths or strands. The panels 12, 14 in one embodiment may be formed of multi-layer air impermeable film, such as an EVOH ply adhesively secured between polypropylene and low density polyethylene plies. One panel, such as the back panel 14, may be embossed or otherwise textured with a pattern, such as a diamond pattern, on both sides spaced between a bottom edge 68 and the closure mechanism 22, and may have a smooth area adjacent to the bottom edge and the top edge. The closure elements in one embodiment 32, 34 may be extruded primarily of molten polyethylene with various amounts of slip component, colorant, and talk additives in a separate process. The fully formed closure profiles 32, 34 may then be attached along opposite edges of one side of the web by placing or extruding a strip of molten thermoplastic weld material 64 onto the web along or adjacent to each edge of the web and immediately placing a closure member 32, 34 onto each strip of molten thermoplastic weld material. The thermoplastic weld material 64 may then be allowed to cool, the web folded together between the two edges to place the closure members 32, 34 in opposing resealable relation, and the web severed transverse to the web direction into discrete pouches, in a manner well known in the art, to form the pouch 10. According to another embodiment, the web, intermediate layer of connecting material 64, and the closure elements 32, 34 may be extruded together simultaneously, and subsequently cooled, folded, and cut. If used, the check valve 28 may be formed on and/or attached to the web prior to folding.

Of course, various details shown in FIGS. 1 and 2 may be modified within the spirit of the present invention. For example, the specific orientation of the closure profiles 32, 34 with respect to the interior 16 may be altered from the orientation shown in the drawings, such that, for example, the male interlocking profile 36 and the female interlocking profile 48 may be disposed on the interior side 16 of the sealing sections. In addition, the location and/or use of the check valve 28 and the air flow channels 30 may be modified as desired. Other methods and materials suitable for forming structures of the present invention may be also be used.

INDUSTRIAL APPLICABILITY

A pouch according to the present invention may be used to pack and to store perishable items contained therein in an air-free or a vacuum environment. According to one embodiment, the closure mechanism of the present invention can provide an air tight seal that is separate from the interlocking members, so as to provide a more secure air tight seal. Clearly, many other and varied uses of the pouch and closure mechanism disclosed herein are also possible.

Numerous modifications to the present invention will be apparent to those skilled in the art in view of the foregoing description. Accordingly, this description is to be construed as being illustrative only, and is presented for the purpose of enabling those skilled in the art to make and to use the invention, and to teach the best mode of carrying out the same. The exclusive rights to all modifications that come within the scope of the appended claims are reserved.

We claim:

1. A resealable pouch comprising:

a front panel connected with a back panel along a peripheral edge to define a sealable interior space therebetween;

an opening defined between the front and back panels along a top edge;

a first elongate closure profile extending along the front panel proximate to the opening, the first elongate closure profile including (i) a base member, (ii) a first interlocking member extending from the base member, (iii) a second interlocking member extending from the base member, and (iv) a first sealing member spaced between the first and second interlocking members, the first sealing member comprising (a) a first sealing wall extending from the base member and comprising a tapered tip, and (b) a second sealing wall extending from the base member and comprising a tapered tip, the first sealing wall being spaced from the second sealing wall to define a tapered channel therebetween, wherein each of the first and second sealing walls comprises a base adjacent to the base member of the first elongate closure profile, such that the tapered tip of each of the first and second sealing walls is narrower than their respective base; and a second elongate closure profile extending along the back panel proximate to the opening, the second elongate closure profile being releasably interlockable with the first closure profile to seal and to unseal the opening, the second closure profile including (i) a base member, (ii) a first interlocking member extending from the base member, (iii) a second interlocking member extending from the base member, and (iv) a second sealing member spaced between the first and second interlocking members, the second sealing member comprising (a) a first sealing rib extending from the base member, (b) a second sealing rib extending from the base member, and (c) a third sealing rib extending from the base member, the first sealing rib being disposed between the second sealing rib and the third sealing rib, and the first sealing rib being wedged between the first sealing wall and the second sealing wall within the tapered channel, wherein the first sealing member is sealingly engageable with the second sealing member, and the first and second interlocking members of the first elongate closure profile are interlockable with the first and second interlocking members of the second elongate closure profile, respectively, wherein the first elongate closure profile is continuously connected to the back panel between the first and second interlocking members of the first closure profile, and wherein the second elongate closure profile is continuously connected to the front panel between the first interlocking member of the second closure profile and the sealing member of the second closure profile, and not connected to the front panel proximate to the second interlocking member of the second closure profile.

2. The resealable pouch of claim 1, wherein the second interlocking member of the second elongate closure profile is disposed on an interior side of the sealing member of the second elongate closure profile.

3. The resealable pouch of claim 1, wherein the first closure profile is connected to the front panel by a substantially continuous first connecting layer disposed therebetween, and the second closure profile is connected to the back panel by a substantially continuous second connecting layer disposed therebetween.

4. The resealable pouch of claim 3, wherein at least one of the first and second connecting layers comprises a thermoplastic weld material.

5. The resealable pouch of claim 1, further comprising a grip ridge disposed on a portion of at least one of the front and back panels, the grip ridge being disposed on an exterior side of the closure profiles.

6. The resealable pouch of claim 1, wherein the first sealing wall is wedged between the first sealing rib and the second sealing rib, and the second sealing wall is wedged between the first sealing rib and the third sealing rib.

7. The resealable pouch of claim 6, wherein each of the first, second, and third sealing ribs has a bulbous head, and each of the first and second sealing walls has tapered sides.

8. The resealable pouch of claim 6, wherein one of the first and second interlocking members of the first elongate closure profile is an elongate arrow-shaped interlocking profile and the other of the first and second interlocking members of the first elongate closure profile is an elongate channel-shaped interlocking profile, and the first and second interlocking members of the second elongate closure profile are complementary respective elongate arrow-shaped male and elongate channel-shaped female interlocking profiles.

9. The resealable pouch of claim 1, further comprising a vacuum check valve disposed in at least one of the front and back panels through which air may be evacuated from the interior space.

10. The resealable pouch of claim 1, further comprising air flow channels defined along at least one of the front and back panels for allowing passage of air during evacuation of the pouch.

11. The resealable pouch of claim 1, wherein the first and second interlocking members of the first elongate closure profile and the first and second sealing walls each extend substantially the same distance from the base member of the first elongate closure profile.

12. The resealable pouch of claim 1, wherein the first and second sealing walls are spaced from the base member of the second elongate closure profile and the first, second, and third sealing ribs are spaced from the base member of the first elongate closure profile when the first and second interlocking members of the first elongate closure profile are interlocked with the first and second interlocking members of the second elongate closure profile.

* * * * *